US007255657B2

(12) United States Patent
Cavallaro et al.

(10) Patent No.: US 7,255,657 B2
(45) **Date of Patent: *Aug. 14, 2007**

(54) GOLF BALL COMPOSITION

(75) Inventors: Christopher Cavallaro, Lakeville, MA (US); Jeffrey L. Dalton, N. Dartmouth, MA (US); Michael D. Jordan, E. Greenwich, RI (US); Herbert C. Boehm, Norwell, MA (US); Samuel A. Pasqua, Jr., Tiverton, RI (US)

(73) Assignee: Acushnet Company, Fairhaven, MA (US)

( * ) Notice: Subject to any disclaimer, the term of this patent is extended or adjusted under 35 U.S.C. 154(b) by 110 days.

This patent is subject to a terminal disclaimer.

(21) Appl. No.: 10/313,043

(22) Filed: Dec. 6, 2002

(65) Prior Publication Data

US 2003/0176241 A1 Sep. 18, 2003

Related U.S. Application Data

(63) Continuation of application No. 09/800,775, filed on Mar. 8, 2001, now Pat. No. 6,517,451, which is a continuation-in-part of application No. 09/027,559, filed on Feb. 23, 1998, now Pat. No. 6,218,453, which is a continuation-in-part of application No. 08/606,373, filed on Feb. 23, 1996, now Pat. No. 5,721,304.

(51) Int. Cl.
*A63B 37/12* (2006.01)

(52) U.S. Cl. ..... 473/378

(58) Field of Classification Search ..... 473/377, 473/378, 351, 371, 367, 368
See application file for complete search history.

(56) References Cited

U.S. PATENT DOCUMENTS

| | | | | |
|---|---|---|---|---|
| 6,152,835 | A * | 11/2000 | Sullivan et al. | 473/373 |
| 6,517,451 | B2 * | 2/2003 | Cavallaro et al. | 473/371 |
| 6,520,870 | B2 * | 2/2003 | Tzivanis et al. | 473/371 |
| 6,555,627 | B2 * | 4/2003 | Bissonnette et al. | 525/274 |
| 6,575,848 | B2 * | 6/2003 | Bissonnette et al. | 473/377 |

* cited by examiner

*Primary Examiner*—Raeann Trimiew
(74) *Attorney, Agent, or Firm*—Bingham McCutchen LLP

(57) ABSTRACT

The invention relates to a solid golf ball having a diameter of less than about 1.70 inches, including a core formed from a rubber base material having a resilience index of at least about 40 and an outer diameter of at least about 1.58 inches, and a cover disposed about the core formed of a material having a Shore D hardness of less than about 65.

25 Claims, 1 Drawing Sheet

GOLF BALL COMPOSITION

CROSS REFERENCE TO RELATED APPLICATIONS

This application is a continuation of U.S. patent application Ser. No. 09/800,775, filed Mar. 8, 2001, now U.S. Pat. No. 6,517,451, which is a continuation-in-part of U.S. patent application Ser. No. 09/027,559, filed Feb. 23, 1998, now U.S. Patent No. 6,218,453, which is a continuation-in-part of U.S. patent application No. 08/606,373, now U.S. Pat. No. 5,721,304, filed Feb. 23, 1996, the contents of which are incorporated in their entirety by express reference thereto.

FIELD OF THE INVENTION

This invention generally relates to golf balls, and, in particular, is directed to an improved low spin golf ball having a soft core and a soft cover.

BACKGROUND OF THE INVENTION

Today, golf balls are generally available as solid and wound balls. Solid golf balls, used by the typical amateur golfer, provide maximum durability and distance. These balls have a core formed of a solid sphere of one or more layers. Typically, these balls have hard cores for high initial velocity and hard covers for low spin and durability.

A number of polymers, such as polybutadiene, natural rubber, styrene butadiene, and isoprene, are used in fabricating the solid cores. Today, golf ball solid cores are predominantly made of polybutadiene. Moreover, in order to obtain the desired physical properties for golf balls, manufacturers have added cross-linking agents, such as metallic salts of an unsaturated carboxylic acid. The amount of cross-linking agent added is typically about 20 to 50 parts per hundred parts of polybutadiene. Most commonly, zinc diacrylate (ZDA) or zinc dimethacrylate are used for this purpose. Of these two cross-linkers, zinc diacrylate has been found to produce golf balls with greater initial velocity than zinc dimethacrylate.

Typically, about 5 to 50 pph (parts per hundred) of zinc oxide (ZnO) is also added to the composition. This material serves as both a filler and an activation agent for the zinc diacrylate/peroxide cure system. The zinc diacrylate/peroxide cure system, which is well known to those of ordinary skill in this art, cross-links the polybutadiene during the core molding process. The high specific gravity of zinc oxide (5.57) can serve the dual purposes of adjusting the weight of the golf ball, in addition to acting as an activation agent.

As zinc oxide is known to be an environmentally unfriendly material, it would be advantageous to eliminate or at least substantially reduce the amount of this material from the manufacturing process. However, when the zinc oxide is eliminated from the composition described above, there is a reduction in cure enhancement, which results in less cross-linking and a corresponding reduction in compression and velocity. This result provides a ball with a softer feel, but the resulting ball has substantially less than the maximum velocity allowed by the USGA standard.

Therefore, it would be advantageous to provide a golf ball core composition with an activation agent other than zinc oxide, i.e., wherein all or at least some of the zinc oxide commonly present was eliminated, which would provide a ball with the lower compression, as noted above, but would maintain the velocity and distance of a high compression ball.

Wound balls, which are generally preferred by better players have higher spin characteristics and softer feel. Wound balls include either a solid rubber or a liquid filled center that is covered by many meters of elastic windings. Such cores are thereafter encased in a cover formed of SURLYN®, polyurethane, or balata rubber. The winding and softer covers provide three-piece balls with higher spin rates and more control for better golfers.

Regardless of the form of the ball, players generally seek a golf ball that delivers maximum distance, which requires a high initial velocity upon impact. Therefore, in an effort to meet the demands of the marketplace, manufacturers generally strive to produce golf balls with initial velocities that approximate the USGA maximum of 77.7 m/s or 255 ft/s as closely as possible.

Golf ball manufacturers are also concerned with varying the level of the compression of the ball, which is a measurement of the deformation of a golf ball or core in inches under a fixed load. Higher velocity on impact, and, hence, greater distance, is generally achieved by increasing the golf ball compression. Higher golf ball compression also generates a harder "feel". Moreover, harder balls must also have a hard cover to keep the driver spin rate down.

As stated above, better players generally prefer the wound golf balls that have soft covers. The soft cover provides increase spin and feel around the greens. However, these players are traditionally giving up distance off the tee because they generate too much spin.

Golf ball manufacturers are continually searching for new ways in which to provide golf balls that deliver the maximum performance for golfers of all skill levels. They seek to discover compositions that provide the distance performance of hard balls and the feel of approach shot spin of softer balls.

SUMMARY OF THE INVENTION

The invention relates to a solid golf ball having a diameter of less than about 1.70 inches, including a core formed from a rubber base material having a resilience index at least about 40 and an outer diameter of at least about 1.58 inches, and a cover disposed about the core formed of a material having a Shore D hardness of less than about 80, preferably less than about 70, more preferably less than about 65.

In a preferred embodiment, the core has an outer diameter at least about 1.59 inches. In another embodiment, the rubber base material has a Mooney viscosity of greater than about 45. Preferably, the rubber base material has a Mooney viscosity of about 50 to about 70.

In another embodiment, the core has a COR of at least about 0.75, preferably at least about 0.80, more preferably at least about 0.81. In yet another embodiment, the core has a compression of less than about 90, preferably less than about 80. Preferably, the core has a compression of less than about 75, more preferably about 60 to about 75.

In another embodiment, the core comprises a filler material having a specific gravity of greater than about 5. Preferably, the core comprises a filler material having a specific gravity of greater than about 10. In another embodiment, the filler material includes tungsten.

In still another embodiment, the cover is formed of a material having a hardness of up to about 65 Shore D, preferably up to about 60 Shore D, more preferably up to about 55 Shore D. Preferably, the cover is formed of a material having a hardness of up to about 50 Shore D. In an additional embodiment, the cover includes a blend of at least one ionomer and at least one metallocene-catalyzed polymer. Preferably, the cover comprises at least about 10 weight percent metallocene-catalyzed polymer, and more preferably the cover comprises about 15 to 60 weight percent metallocene-catalyzed polymer.

In an additional embodiment, at least one of the core or cover is formed of at least about 80% trans-isomer polybutadiene. In yet another embodiment, at least one of the core or cover is formed of about 10% to 80% trans-isomer polybutadiene. In still another embodiment, the core comprises a rubber material having a molecular weight of greater than about 200,000. Preferably, the core comprises a rubber material having a molecular weight of greater than about 300,000. In another embodiment, the core includes a material with a Mooney viscosity of at least about 40 and a filler including regrind.

The invention also relates to a two-piece golf ball having a diameter of less than about 1.70 inches, including a core formed from a rubber base material having a molecular weight of at least about 300,000 and an outer diameter of at least about 1.58 inches, and a cover disposed about the core formed of a material having a Shore D hardness of less than about 65.

In one embodiment, the rubber base material has a Mooney viscosity of greater than about 40. In another embodiment, the core has a core of at least about 0.80. In still another embodiment, the core has a compression of less than about 75. In a further embodiment, the core includes a filler material having a specific gravity of greater than about 10. In yet another embodiment, the cover is formed of a material having a hardness of up to about 55 Shore D.

The invention further relates to a golf ball having a diameter of less than 1.70 inches, including a core having a compression of less than about 75 and an outer diameter of at least about 1.58 inches, and a cover disposed about the core formed from a material having a Shore D hardness of less than about 60.

In one embodiment, the core is formed from a rubber base material having a Mooney viscosity of greater than about 40. In another embodiment, the core has a COR of at least about 0.80. In still another embodiment, the core includes a filler material having a specific gravity of greater than about 10.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

The present invention is directed to an improved low spin ball for good distance characteristics and soft cover for softer feel. More particularly, the present invention is directed to a golf ball having a large, soft core with a low compression. Further, the present invention has a thin, soft cover to provide a soft feel and maintain velocity.

As used herein, the terms "core" and "golf ball core" are generic, and include cores for solid golf balls, and cores having two or more layers for solid golf balls. The core composition of the present invention can be used to form a unitary golf ball, a core for a solid golf ball, or a center for a three-piece or wound golf ball, as desired. As set forth below, however, the invention is primarily directed to the use of the novel compositions to form a core for a solid, non-wound ball with a soft cover preferably formed from a blend of materials such as SURLYN® ionomer resins.

As used herein, the terms "hardness" or "material hardness" shall mean the hardness of a slab of material on the ball according to ASTM 2240-00, rather than hardness of the ball itself.

For purposes of the present invention, the term "reaction conditions" can refer to any reaction condition that can affect the ability of the inventive core compositions to form free radicals. Reaction conditions include, for example, temperature, time and pressure.

As used herein, the terms "compression" or "compression points" refer to the compression scale based on the ATTI Engineering Compression Tester. This scale, which is well known to those working in this field, ranges from 1 to 160 points and is used in determining the relative compression of a core or ball material. Some ordinary-skilled artisans who do not use the PGA compression scale instead use Reihle compression values or some other defection in mm under a certain load. Based on disclosure in U.S. Pat. No. 5,368,304, the Reihle compression values may be converted to standard compression values through the use of the following equation:

$$\text{compression points} = 160 - \text{Reihle compression value}.$$

Figure 1:
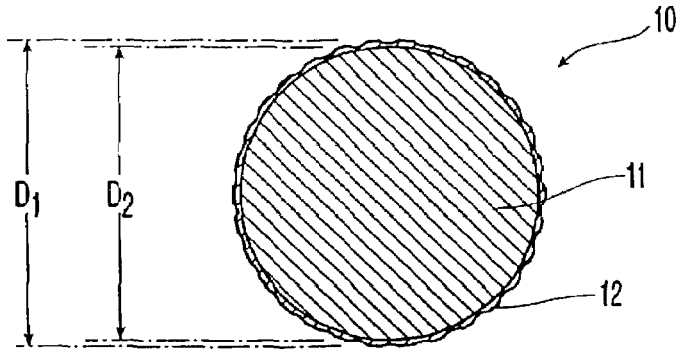
FIG. 1 is a cross-section of a golf ball according to the present invention.

Referring to FIG. 1, the present invention in a preferred embodiment is directed to an improved low spin golf ball 10 comprising a core 11 and a cover 12. The ball 10 has a first diameter D1 that is 1.68 inches or greater and the core 11 has a second diameter D2 that is 1.55 inches or greater, preferably greater than about 1.58 inches.

Figure 2:
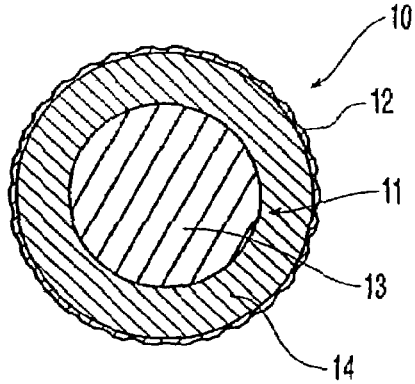
FIG. 2 is a cross-section of a second embodiment of a golf ball according to the present invention.

As set forth in FIG. 2, the present invention can also include a golf ball 10 comprising a core 11 and a cover 12 wherein the core 11 is comprised of more than one layer, i.e., a center 13 and an outer layer 14. Preferably, both the center 13 and the outer layer 14 are solid, non-wound layers comprised of polybutadiene rubber compositions with the outer layer 14 being softer than the center 13 as discussed in more detail below. In another embodiment, the center 13 is softer than the outer layer 14.

Figure 3:
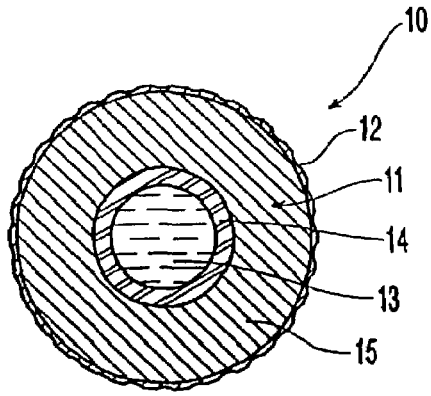
FIG. 3 is a cross-section of a third embodiment of a golf ball according to the present invention.

Finally, referring to FIG. 3, another embodiment of the present invention is directed to a golf ball 10 comprised of a core 11 and a cover 12, wherein the core 11 is comprised of a fluid center 13, a first solid, non-wound layer surrounding the fluid center 14 and a second solid, non-wound layer 15. In each of these embodiments, the golf ball includes a soft, low compression, non-wound core 11 and a soft cover 12 having one or more layers, as set forth in more detail below.

The invention is also directed to the composition for the manufacture of improved low spin golf balls, and, in particular, golf ball cores and covers. The improved golf ball core composition comprises polybutadiene, a metal salt diacrylate or dimethacrylate, preferably, zinc diacrylate in an amount of about 20 to 50 parts per hundred parts of polybutadiene, and a free radical initiator, to which calcium oxide (CaO) or zinc oxide can be added as an activation agent in an amount sufficient to produce a golf ball core with the advantageous properties discussed below. Moreover, the core can be a large core so that a suitable initial velocity can be obtained when using a soft cover.

A representative base composition for forming a soft golf ball core 11, prepared in accordance with the present invention, comprises polybutadiene and, in parts by weight based on 100 parts polybutadiene, 20 to 50 parts of a metal salt diacrylate, dimethacrylate, or monomethacrylate, preferably zinc diacrylate. The polybutadiene preferably has a cis 1,4 content of above about 90% and more preferably above about 96%. Commercial sources of polybutadiene include Shell 1220 manufactured by Shell Chemical, Neocis BR40 and BR60 manufactured by Enichem Elastomers, Ubepol BR150 and 360 manufactured by Ube Industries, Ltd., CB23 manufactured by Bayer AG, and BUDENE 1207G, manufactured by Goodyear. In one preferred embodiment, the core may include one or more of BR60, 360, CB23, and BUDENE 1207G, because of the higher resilience index of these materials. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are generally based on 100 parts by weight of the total elastomer mixture.

The golf ball can also be formed of a rigid composition that includes at least about 80 percent trans-isomer content with the rest being cis-isomer 1,4-polybutadiene and vinyl-isomer 1,2-polybutadiene. In varying embodiments, the core, the cover, or both can include such material. A detailed discussion of such composition is set forth in U.S. application Ser. No. 09/741,053, the contents of which are incorporated herein by reference thereto.

Also, the golf ball may be formed of a resilient controlled-isomer polybutadiene polymer that typically includes at least about 10 percent up to 80 percent trans-isomer content with the rest being cis-isomer and vinyl-isomer distributed randomly, pseudo-randomly, or in block fashion along the same polybutadiene backbone. In varying embodiments, the core, the cover, or both can include such material. A detailed discussion of such compositions is set forth in U.S. application Ser. No. 09/741,052, the contents of which are incorporated herein by reference thereto.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing about 1-10% zinc stearate is preferable. More preferable is zinc diacrylate containing about 4-8% zinc stearate. Suitable, commercially available zinc diacrylates include those from Rockland React-Rite and Sartomer. The preferred concentrations of zinc diacrylate that can be used are 20-50 pph based upon 100 parts of polybutadiene or alternately, polybutadiene with a mixture of other elastomers.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a-a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph.

A typical prior art golf ball core incorporates 5 to 50 pph of zinc oxide in a zinc diacrylate-peroxide cure system that cross-links polybutadiene during the core molding process. The high specific gravity of zinc oxide, about 5.57, permits the adjustment of the specific gravity of the core and resulting golf ball incorporating the core. As noted above, the elimination, or at least the reduction of environmentally unfriendly zinc oxide from the manufacturing process is desirable in certain circumstances. In the case of golf ball core formulations, however, completely eliminating zinc oxide results in a significant reduction in cure enhancement, so that there is a reduction in the cross-linking of the polybutadiene with a resultant decrease in both compression and initial velocity in the USGA test. Although the core and resulting ball has a softer feel, driving distance suffers as a result of the significantly lower initial velocity. When zinc oxide (ZnO) is eliminated in favor of calcium oxide (CaO) in a golf ball core composition of polybutadiene and a metal salt diacrylate, dimethacrylate, or monomethacrylate, the cores and balls produced from such an admixture typically exhibit enhanced performance properties. The initial velocity of the standard ball is maintained at or near the maximum allowed by the USGA, but the compression of the ball is reduced by at least about 2 compression points on the PGA scale, and may be reduced as much as 14 points. Where the amount of zinc oxide incorporated in prior art cores is, as noted above, typically about 5 to 50 pph, the amount of calcium oxide added to the core-forming composition of the invention as an activator is typically in the range of about 0.1 to 15, preferably 1 to 10, most preferably 1.25 to 5, parts calcium oxide per hundred parts (pph) of polybutadiene.

The compositions of the present invention may also include fillers, added to the elastomeric composition to adjust the density and/or specific gravity of the core. As used herein, the term "fillers" includes any compound or composition that can be used to vary the density and other properties of the subject golf ball core. Fillers useful in the golf ball core according to the present invention include, for example, zinc oxide (in an amount significantly less than that which would be necessary without the addition of the calcium oxide), barium sulfate, and regrind (which is recycled core molding matrix ground to 30 mesh particle size). The amount and type of filler utilized is governed by the amount and weight of other ingredients in the composition, since a maximum golf ball weight of 1.620 ounces (45.92 gm) has been established by the USGA. Appropriate fillers generally used range in specific gravity from about 2.0 to 5.6. In another embodiment, the specific gravity can be from about 2 to 20.

Golf ball cores made according to the present invention can be of any specific gravity which can be used in a golf ball. The preferred range of specific gravities of the present invention is from about 0.9 to about 1.5 or more, more preferably in the range of about 1 to about 1.25, depending upon the size of the core, cover, and finished ball, as well as the specific gravity of the cover. For example, the core specific gravity will be lower if the cover includes a filler to increase the specific gravity of the cover.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g., tetra methylthiuram, processing aids, processing oils, plasticizers, dyes and pigments, as well as other additives well known to the skilled artisan may also be used in the present invention in amounts sufficient to achieve the purpose for which they are typically used.

The compositions of the invention are typically produced by forming a mixture comprising at least polybutadiene, zinc diacrylate, and an amount of calcium oxide sufficient, when desired, to reduce the compression by at least about 2 points on the PGA compression scale, compared to a core composition substituting zinc oxide for the calcium oxide, optionally with one or more additional components, such as additives. When a set of predetermined conditions is met, i.e., time and temperature of mixing, the free radical initiator is added in an amount dependent upon the amounts and relative ratios of the starting components, as would be well understood by one of ordinary skill in the art. In particular, as the components are mixed, the resultant shear causes the temperature of the mixture to rise.

Peroxide(s) free radical initiator(s) are blended into the mixture for crosslinking purposes in the molding process.

After completion of the mixing, the golf ball core composition is milled and hand prepped or extruded into pieces ("preps") suitable for molding. The preps are then compression molded into cores at an elevated temperature. Typically, 160° C. (320° F.) for 15 minutes is suitable for this purpose. These cores can then be used to make finished golf balls by surrounding the cores with standard cover materials.

Methods for measuring the resiliency of golf balls are well known by those of ordinary skill in the art. One method of measuring the resiliency of a ball at impact is to utilize an air cannon or other means of propelling a ball at velocities equivalent to those of a golf club head. The balls are fired at a massive rigid block, with the inbound and outbound velocities being measured. The velocity may be measured by the use of light screens, which measure the time required for the ball to travel a fixed distance. The fixed distance divided by the transit time is equivalent to the average velocity of the ball over the fixed distance. The ratio of the outbound velocity to the inbound velocity is commonly referred to as the coefficient of restitution ("COR"). The COR is a direct measure of the resilience of a golf ball at a particular inbound velocity. Since golf balls behave in a linear-viscoelastic fashion, inbound ball velocity is functionally equivalent to club swing speed.

As used herein the term "resilience index" is defined as the difference in loss tangent (tan δ) measured at 10 cpm and 1000 cpm divided by 990 (the frequency span) multiplied by 100,000 (for normalization and unit convenience). The loss tangent is measured using an RPA 2000 manufactured by Alpha Technologies of Akron, Ohio. The RPA 2000 is set to sweep from 2.5 to 1000 cpm at a temperature of 100° C. using an arc of 0.5 degrees. An average of six loss tangent measurements were acquired at each frequency and the average is used in calculation of the resilience index. The computation of resilience index is as follows:

$$\text{Resilience Index}=100{,}000@[(\text{loss tangent}@10\ \text{cpm})-(\text{loss tangent}@1000\ \text{cpm})]/990$$

The invention also relates to a two-piece performance golf ball having a core with an outer diameter greater than about 1.58 inches, a golf ball compression of less than about 90, preferably less than about 80, a COR greater than about 0.75, preferably at least about 0.80, more preferably at least about 0.81, and a cover formed of a material with a Shore D hardness of less than about 80, preferably less than about 70, more preferably less than about 65. Such a construction provides a golf ball that has a soft feel, a lower driver spin rate, and an increased spin rate on wedge shots compared to many conventional two-piece golf balls.

The core of the ball is typically formulated with a high Mooney viscosity polybutadiene rubber and preferably includes tungsten powder as a filler. The compositions of the present invention may also include other fillers, added to the polybutadiene material to adjust the density and/or specific gravity of the core or to the cover. As used herein, the term "fillers" includes any compound or composition that can be used to adjust the density and/or other properties of the subject golf ball core. Fillers useful in the golf ball core of the invention are typically polymeric or mineral particles. Exemplary fillers include precipitated hydrated silica; clay; talc; asbestos; glass fibers; aramid fibers; barium sulfate; mica; calcium metasilicate; regrind, which is ground, recycled core material (for example, ground to about 30 mesh particle size); zinc sulfide; lithopone; silicates; silicon carbide; diatomaceous earth; polyvinyl chloride; carbonates such as calcium carbonate and magnesium carbonate; metals, such as titanium, tungsten, aluminum, bismuth, nickel, molybdenum, iron, lead, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, tin oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof. In a preferred embodiment, the filler includes barium sulfate, tungsten, and zinc oxide. The amount and type of filler utilized is governed by the amount and weight of other ingredients in the composition, since a maximum golf ball weight of 45.93 g (1.62 ounces) has been established by the United States Golf Association (USGA). Appropriate fillers generally used have a preferred specific gravity of greater than about 5. In one preferred embodiment, the filler has a specific gravity greater than about 19.

In one embodiment, the core material has a Mooney viscosity of greater than about 40, preferably about 50 to about 70. In one preferred embodiment, the Mooney viscosity can be about 55 to about 65. This combination of rubber and filler furnishes a core with a higher resiliency. In one embodiment, the resilience index of the core is greater than about 40, preferably greater than about 45. In one preferred embodiment, the resilience index of the core is greater than about 50. The core compression can thus be reduced, thereby decreasing the overall spin rate of the ball without a significant loss in golf ball initial velocity. An exemplary finished ball velocity according to the present invention can advantageously be about 253.5 to 254.5 ft/s. These correspond to CORs of 0.812 and 0.818 respectively. Polymers that produce resilient cores include, but are not limited to, CB23, BR60, or a blend thereof. CB23 is commercially available from Bayer Corporation of Akron, Ohio.

As used herein, the term "molecular weight" is defined as the absolute weight average molecular weight. The molecular weight is determined by the following method: approximately 20 mg of polymer is dissolved in 10 mL of tetrahydrofuran ("THF"), which may take a few days at room temperature depending on the polymer's molecular weight and distribution. One liter of THF is filtered and degassed before being placed in a high-performance liquid chromatography ("HPLC") reservoir. The flow rate of the HPLC is set to 1 mL/min through a Viscogel column. This non-shedding, mixed bed, column model $GMH_{HR}$-H, which has an ID of 7.8 mm and 300 mm long is available from Viscotek Corp. of Houston, Tex. The THF flow rate is set to 1 mL/min for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment. A 100-μL aliquot of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein. In one embodiment, the core includes a rubber material having a molecular weight of greater than about 200,000, preferably greater than about 300,000. In a preferred embodiment, the molecular weight of the rubber material of the core is greater than about 350,000. In a further embodiment, the molecular weight of the rubber material is greater than about 250,000, preferably from about 300,000 to 500,000.

In a preferred embodiment, the core has a larger diameter of at least about 1.59 inches. In another preferred embodiment, a golf ball has a core compression of less than about 75, preferably from about 60 to about 75. In one preferred embodiment, the golf ball has a core compression of about 68 to about 72. In yet another preferred embodiment, the golf ball has a COR of at least about 0.75, preferably at least about 0.80, more preferably at least about 0.81.

The core may also contain a coating of latex, or latex may be used as an intermediate layer disposed about the core. Typical thermosetting latex materials which can be used to coat the cores include low ammonia natural latex and/or pre-vulcanized natural latex. Natural latex is noted for its combination of high tensile strength, excellent elasticity, tack, low modulus, and ability to form strong, coherent, wet and dry films. Natural rubber latex is also relatively inert, nontoxic, cost effective, compatible with most core and outer shell rubber compounds, and can be air dried. This layer can prevent the escape of moisture from a fluid-filled center and also prevent moisture from the atmosphere from entering the ball.

The ball may also be coated with, or contain as an intermediate layer, a responsive viscoelastic composition. These compositions include solids, semi-solids, gels, or gel-like materials that have a rheopectic, dilatant, or thixotropic viscosity that exhibit an increase in viscosity in response to shear forces, tensile forces, compressive strain, or a combination thereof. Suitable materials include those described in U.S. patent application Ser. No. 09/767,723 filed Jan. 24, 2001, the disclosure of which is incorporated herein by express reference thereto. Indeed, the material can be formed as a coating or film disposed about a portion of a golf ball, preferably entirely surrounding the portion of the ball being coated; or the material can be formed by any conventional golf ball layer forming method including compression, injection, or reaction injection molding, casting, or the like, depending upon the material. Preferably, the responsive viscoelastic composition forms at least one continuous layer of material. In this embodiment, the intermediate layer can be placed at any point in the ball between the inner layer of the core and the outer cover layer.

The cover disposed about the core can include a FUSABOND® cover blend of at least about 10 weight percent of a FUSABOND® polymer. FUSABOND® refers to certain grafted metallocene-catalyzed polymers, such as those commercially available from E. I. DuPont deNemours & Co. of Wilmington, Del. under the tradenames SURLYN® NMO 525D, SURLYN® NMO 524D, and SURLYN® NMO 499D, all formerly known as the FUSABOND® family of polymers. FUSABOND® has shown an increase in velocity in golf ball cover over VLMI at the same hardness, thus, in one preferred embodiment more FUSABOND® material is included than VLMI. The FUSABOND® thus can advantageously increase the maximum initial velocity of the ball, which might have been lowered due to the lower core compression, a decrease in which normally may tend to reduce initial velocity of the ball. In a preferred embodiment, the cover includes about 10 to 60 weight percent FUSABOND®, preferably about 15 to 50 weight percent FUSABOND®. For example, suitable cover materials include one or more of those materials described herein for the impregnation material.

Further suitable cover materials can include any known to those of ordinary skill in the art, including but not limited to, one or more homopolymeric or copolymeric materials, such as:

(1) Vinyl resins, such as those formed by the polymerization of vinyl chloride, or by the copolymerization of vinyl chloride with vinyl acetate, acrylic esters or vinylidene chloride;
(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst;
(3) Polyurethanes, such as those prepared from polyols and diisocyanates or polyisocyanates and those disclosed in U.S. Pat. No. 5,334,673;
(4) Polyureas, such as those disclosed in U.S. Pat. No. 5,484,870;
(5) Polyamides, such as poly(hexamethylene adipamide) and others prepared from diamines and dibasic acids, as well as those from amino acids such as poly(caprolactam), and blends of polyamides with SURLYN, polyethylene, ethylene copolymers, ethyl-propylene-non-conjugated diene terpolymer, and the like;
(6) Acrylic resins and blends of these resins with poly vinyl chloride, elastomers, and the like;
(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by ELF Atochem of Philadelphia, Pa.;
(8) Polyphenylene oxide resins or blends of polyphenylene oxide with high impact polystyrene as sold under the trademark NORYL by General Electric Company of Pittsfield, Mass.;
(9) Thermoplastic polyesters, such as polyethylene terephthalate, polybutylene terephthalate, polyethylene terephthalate/glycol modified and elastomers sold under the trademarks HYTREL by E. I. DuPont de Nemours & Co. of Wilmington, Del., and LOMOD by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

(12) Solvent and suspension based latexes of polyisoprene or polybutadiene.

(13) Reactive resins, such as expoxies, polyesters, and polyamides.

Particularly suitable cover materials include trans-polyisoprene, ionomer resin, polyurethane, or a combination thereof. The cover may be a construction of one or more layers, but is typically either one or two layers. Suitable methods include, for example, compression molding, injection molding, or casting.

Further core embodiments are listed in Table I, wherein all of the ball properties are independent of each other.

TABLE I

| Core Compression | Core Diameter (in.) |
|---|---|
| 70 | 1.57 |
| 67 | 1.58 |
| 65 | 1.60 |
| 63 | 1.62 |
| 60 | 1.63 |
| 55 | 1.64 |
| 50 | 1.67 |

As indicated above, the core compressions and core diameters are independent one from another. In other words, an embodiment is contemplated where, for example, the core compression is 67 and the core diameter is 1.68. These are also not discrete embodiments, as the ranges between each is also contemplated. For example, a core compression of 64 and a core diameter of 1.66 is also contemplated by the present invention. As the core gets larger, the core can be made softer while retaining its COR and still obtaining the benefit of lower spin from lower core compression. The cover can then be modified as desired to obtain higher spin using short-game iron shots, leaving the lower spin when the ball is struck by a driver.

In another embodiment, the cover hardness can be reduced by at least about 2, preferably at least about 5, Shore D hardness points, which can increase the spin from irons and maintain driver spin.

CORE EXAMPLES

These and other aspects of the present invention may be more fully understood with reference to the following non-limiting examples, which are merely illustrative of the preferred embodiments of the present invention, and are not to be construed as limiting the invention, the scope of which is defined by the appended claims.

Examples 1-3

The results obtained with golf ball cores and balls prepared according to the following examples are representative of the improved performance characteristics of golf ball cores and golf balls made from the core compositions of this invention. The core compositions used to prepare the golf balls of these examples contained the ingredients listed in Table I below in the specified amounts, which are all in parts per hundred (pph), based on 100 parts of polybutadiene. The fillers used in the compositions of these examples are regrind and barium sulfate ($BaSO_4$). Either calcium oxide or zinc oxide is used as an activation agent. Vulcup 40KE® and Varox 231XL® are free radical initiators, and are a-a bis (T-butylperoxy) diisopropylbenzene and 1,1-di (T-butylperoxy) 3,3,5-trimethyl cyclohexane, respectively. Yel MB is a yellow pigment in a styrene butadiene binder, which is used to color the composition for identification purposes. The zinc diacrylate contained no more than about 4% to 8% zinc stearate.

All the ingredients except the peroxides were mixed in a Process Lab Brabender mixer to 82.2 to 93.3° C. (180 to 200° F.). The peroxides were added in the second stage to the initial mixture, and the resulting mixture was removed from the Brabender and blended on a lab mill to insure homogeneity. After mixing, the admixture was then hand rolled using a laboratory mill and cut into pieces or "preps". These preps were then compression molded at 160° C. (320° F.) for 15 minutes to form the cores. To fabricate the finished golf balls, the cores were inserted into two cover hemispheres of a lithium-sodium blend of SURLYN®, which were molded to encase the core.

The cores and balls prepared according to the above-described method were tested for their compression and initial velocity. The compression ratings were obtained using an ATTI compression tester. The initial velocity results were obtained from a standard technique, whereby the cores or balls are struck at 39.6 m/s (130 ft/s), and pass through light gates, which measure their speed. Both of these standard measurement techniques are well-known to those of ordinary skill in the art of making golf ball cores and balls.

TABLE II

| | Control | 1 | 2 | 3 |
|---|---|---|---|---|
| Polybutadiene | 100.0 | 100.0 | 100.0 | 100.0 |
| Regrind | 16.3 | 16.3 | 16.3 | 16.3 |
| Vulcup 40KE ® | 0.23 | 0.23 | 0.23 | 0.23 |
| Varox 231XL ® | 0.43 | 0.43 | 0.43 | 0.43 |
| $BaSO_4$ | 20.5 | 20.5 | 20.5 | 20.5 |
| Yel MB | 0.10 | 0.10 | 0.10 | 0.10 |
| Zinc diacrylate | 26.9 | 26.9 | 26.9 | 26.9 |
| Zinc Oxide | 5.0 | 2.5 | — | — |
| Calcium Oxide | — | — | — | 5.0 |

TABLE III

| | Control | 1 | 2 | 3 |
|---|---|---|---|---|
| Zinc Oxide (pph) | 5.0 | 2.5 | — | — |
| Calcium Oxide (pph) | — | — | — | 5.0 |
| Core Initial Velocity | 250.79 | 250.83 | 250.19 | 250.33 |
| Ball Initial Velocity | 253.47 | 253.42 | 253.01 | 253.44 |
| Core Compression | 80.4 | 77.1 | 68.4 | 71.3 |
| Ball Compression | 97.8 | 96.2 | 85.8 | 90.3 |

As shown in Table III, a 50 percent reduction in the zinc oxide concentration in Example 1 results in a decrease in ball compression of only 1.6 points and a slight drop in initial velocity. Similar results are obtained with the core. The complete removal of zinc oxide in Example 2 reduces the compression of both the core and the ball by 12 points, but also reduces the initial velocity of the core and ball significantly. When the zinc oxide is eliminated from the core composition, and calcium oxide is added in Example 3, both the cores and finished balls containing calcium oxide have a lower compression, but the initial velocity of the low compression balls and cores is comparable to that of the high compression control.

Examples 4-8

The cores and finished balls of these examples were prepared according to the method used in Examples 1-3. However, the zinc oxide concentration was varied over a wider range. Table IV provides a description of the contents of the balls used in each of these examples. Again the quantities are in terms of parts per 100 parts of polybutadiene.

TABLE IV

| | Control | 4 | 5 | 6 | 7 | 8 |
|---|---|---|---|---|---|---|
| Polybutadiene | 100.0 | 100.0 | 100.0 | 100.0 | 100.0 | 100.0 |
| Regrind | 16.3 | 16.3 | 16.3 | 16.3 | 16.3 | 16.3 |
| Vulcup 40KE ® | 0.23 | 0.23 | 0.23 | 0.23 | 0.23 | 0.23 |
| Varox 231XL ® | 0.43 | 0.43 | 0.43 | 0.43 | 0.43 | 0.43 |
| $BaSO_4$ | 20.5 | 20.5 | 20.5 | 20.5 | 20.5 | 20.5 |
| Yel.MB | 0.10 | 0.10 | 0.10 | 0.10 | 0.10 | 0.10 |
| Zinc Diacrylate | 26.9 | 26.9 | 26.9 | 26.9 | 26.9 | 26.9 |
| Zinc Oxide | 5.0 | 3.75 | 2.5 | 1.25 | — | — |
| Calcium Oxide | — | — | — | — | — | 5.0 |

TABLE V

| | Control | 4 | 5 | 6 | 7 | 8 |
|---|---|---|---|---|---|---|
| Zinc Oxide (pph) | 5.0 | 3.75 | 2.5 | 1.25 | — | — |
| Calcium Oxide (pph) | — | — | — | — | — | 5.0 |
| Core Initial Velocity | 250.36 | 251.00 | 250.79 | 250.80 | 249.95 | 250.14 |
| Ball Initial Velocity | 252.50 | 252.89 | 252.83 | 252.78 | 252.14 | 252.67 |
| Core PGA Compression | 76.5 | 76.4 | 73.8 | 73.8 | 65.9 | 67.4 |
| Ball PGA Compression | 93.8 | 96.0 | 94.2 | 93.7 | 87.6 | 87.5 |

Table V illustrates the compression ratings and initial velocity results for Examples 4-8. These results were obtained by the same measurement techniques described above. The results further show that small decreases in the zinc oxide concentration have little or no effect on the compression and initial velocities of either the cores or the complete golf balls. The complete removal of zinc oxide, however, results in significant reductions in compression, i.e., 10.6 points for the cores and 6.2 points for the complete golf balls, and a significant reduction in the initial velocities of both the cores and the completed golf balls. The present invention, as discussed above, comprises embodiments wherein the zinc oxide is totally excluded, as well as those in which the zinc oxide is present, but in significantly reduced amounts due to the addition of the calcium oxide. Example 8 shows that the replacement of the zinc oxide filler with calcium oxide provides a reduction in core compression of 9.1 points and a reduction in ball compression of 8.5 points, while the initial velocity of both the core and the complete ball in the USGA test are again comparable.

Examples 9-10

The cores and finished balls of these examples were prepared according to the method used in Examples 1-8. However some variations were made to the amounts of ingredients used as shown in Table VI. Again the quantities are in terms of parts per 100 parts of polybutadiene.

TABLE VI

| | Control | 9 | 10 |
|---|---|---|---|
| Polybutadiene | 100.0 | 100.0 | 100.0 |
| Regrind | 16.3 | 16.3 | 16.3 |
| Vulcup 40KE ® | 0.23 | 0.23 | 0.23 |
| Varox 231XL ® | 0.43 | 0.43 | 0.43 |
| $BaSO_4$ | 20.5 | 20.5 | 20.5 |
| Yel.MB | 0.10 | 0.10 | 0.10 |
| Zinc Diacrylate | 26.9 | 26.9 | 26.9 |
| Zinc Oxide | 5.0 | 1.25 | — |
| Calcium Oxide | — | — | 5.0 |

TABLE VII

| | Control | 9 | 10 |
|---|---|---|---|
| Zinc Oxide (pph) | 5.0 | 1.25 | — |
| Calcium Oxide (pph) | — | — | 5.0 |
| Core Initial Velocity | 250.94 | 250.98 | 250.66 |
| Ball Initial Velocity | 253.18 | 253.04 | 252.97 |
| Core Compression | 79.4 | 75.2 | 73.1 |
| Ball Compression | 97.7 | 96.6 | 92.5 |

Table VII illustrates the compression ratings and initial velocity results for Examples 9-10. These results were obtained by the same measurement techniques described above. The results further show that the compositions of this invention generally provide cores and finished balls with decreased compression rating, yet with an initial velocity comparable to higher compression balls.

Examples 11-19

These examples show the effects of varying the concentration of both zinc oxide and calcium oxide. The concentrations of the ingredients used in the various compositions are shown in Table VIII. Again the quantities of the ingredients are in terms of parts per 100 parts of polybutadiene.

TABLE VIII

| | Control | 11 | 12 | 13 | 14 | 15 | 16 | 17 | 18 | 19 |
|---|---|---|---|---|---|---|---|---|---|---|
| Polybutadiene | 100 | 100 | 100 | 100 | 100 | 100 | 100 | 100 | 100 | 100 |
| Regrind | 16.3 | 16.3 | 16.3 | 16.3 | 16.3 | 16.3 | 16.3 | 16.3 | 16.3 | 16.3 |

TABLE VIII-continued

| | Control | 11 | 12 | 13 | 14 | 15 | 16 | 17 | 18 | 19 |
|---|---|---|---|---|---|---|---|---|---|---|
| Vulcup 40KE ® | 0.23 | 0.23 | 0.23 | 0.23 | 0.23 | 0.23 | 0.23 | 0.23 | 0.23 | 0.23 |
| Varox 231XL ® | 0.43 | 0.43 | 0.43 | 0.43 | 0.43 | 0.43 | 0.43 | 0.43 | 0.43 | 0.43 |
| $BaSO_4$ | 20.5 | 22.0 | 23.1 | 24.2 | 25.8 | 21.5 | 22.5 | 23.5 | 24.7 | 12.0 |
| Yel.MB | 0.10 | 0.10 | 0.10 | 0.10 | 0.10 | 0.10 | 0.10 | 0.10 | 0.10 | 0.10 |
| Zinc Diacrylate | 26.9 | 26.9 | 26.9 | 26.9 | 26.9 | 26.9 | 26.9 | 26.9 | 26.9 | 26.9 |
| Zinc Oxide | 5.0 | 3.75 | 2.50 | 1.25 | — | — | — | — | — | — |
| Calcium Oxide | — | — | — | — | — | 5.0 | 3.75 | 2.50 | 1.25 | 15.0 |

TABLE IX

| | Control | 11 | 12 | 13 | 14 | 15 | 16 | 17 | 18 | 19 |
|---|---|---|---|---|---|---|---|---|---|---|
| Zinc Oxide (pph) | 5.0 | 3.75 | 2.50 | 1.25 | — | — | — | — | — | — |
| Calcium Oxide (pph) | — | — | — | — | — | 5.0 | 3.75 | 2.50 | 1.25 | 15.0 |
| Core Initial Velocity | 250.63 | 250.74 | 250.55 | 250.52 | 249.38 | 250.56 | 250.30 | 250.21 | 250.24 | 248.56 |
| Ball Initial Velocity | 252.62 | 252.83 | 252.62 | 252.43 | 251.71 | 252.91 | 252.80 | 252.81 | 252.55 | 250.92 |
| Core PGA Compression | 81.2 | 81.8 | 78.8 | 78.4 | 70.1 | 69.7 | 68.8 | 69.2 | 70.5 | 44.1 |
| Ball PGA Compression | 97.0 | 100.3 | 98.3 | 96.8 | 89.6 | 88.2 | 87.6 | 86.4 | 88.4 | 62.8 |

Table IX illustrates the compression ratings and initial velocity results for Examples 11-19. These results were obtained by the same measurement techniques described above. The results show that the advantages of the present invention are available with amounts of calcium oxide as low as 1.25 pph.

Referring to the core 11 shown in FIG. 2, the center is preferably harder than the outer layer. More particularly, the core has a compression ratio of at least 10, and preferably 20, more than the outer layer. The compression ratio being determined by a core made entirely of the material of each layer, i.e., the compression ratio for the center is determined by forming a 1.58 inch core of the first layer material and testing its compression on an ATTI Engineering Compression Tester. The center preferably has a compression ratio of greater than 80 compression points and the outer layer has a compression ratio of less than 60 compression points. Thus, the overall ball compression can be maintained to a compression of less than 80 compression points.

The center of the ball shown in FIG. 2 has a diameter of about 0.75 to 1.25 inches and preferably is comprised of a polybutadiene rubber with zinc oxide as the cross linking agent and the outer layer is a polybutadiene with calcium oxide as the cross linking agent as set forth above. In the most preferred embodiment, the center has a diameter of about 0.95 inches and is comprised of the formulation set forth in comparative Example 11 above and the outer layer is formed from the formulation set forth in Example 15 above.

Moreover, the invention includes a soft cover formed of a material with a hardness of less than about 80 Shore D. Preferably, the cover is thinner than prior art golf balls to compensate for the large core. In one embodiment, the cover thickness is less than about 0.06 inches (1.47 mm). In a preferred embodiment, the cover thickness is less than about 0.059 inches (1.45 mm). In another embodiment, the cover thickness is less than about 0.055 inches (1.35 mm), preferably less than about 0.051 inches (1.25 mm). The cover preferably weighs less than about 15 grams. In one preferred embodiment, the cover weighs less than about 11 grams. Also, the cover is preferably comprised of an ionomer blend that is a combination of at least two ionomer resins having different flexural moduli. Preferably, the ionomers are each copolymers or terpolymers with an olefin and an alpha, beta-unsaturated carboxylic acid that is partially neutralized with a metal salt. In one preferred embodiment, the cover is formed from the ionomer blend and the metallocene-catalyzed polymer described herein. In one embodiment, the cover can be formed from two or more different SURLYN ionomers and FUSABOND®. The cover can also be formed of non-ionomeric FUSABOND®. The cover can further be formed of one or more suitable ethylene methacrylic/acrylic acid copolymers, such as those sold commercially by DuPont under the tradename NUCREL®. In one preferred embodiment, the cover contains up to about 15% NUCREL®, more preferably about 2% to 12% NUCREL®. In one embodiment, NUCREL® 960 is included.

The combination of the soft cover with the large, lower compression golf ball core of the preferred embodiment can advantageously provide a ball with a high initial velocity and low driver spin rate for distance, as well as a soft feel and high approach shot spin rate for control and feel around the greens when struck with an iron.

The cover of the present invention is thinner to accommodate for the large core and maintain initial velocity. In one embodiment, the cover is preferably 0.04 to 0.065 inches thick. It is preferably made of a soft feel material such as natural or synthetic balata, polyurethane, or a soft surlyn blend. More preferably the cover is comprised of a blend of two materials, a very soft material and a harder material. Preferably, the cover is comprised of about 5 to about 60 parts by weight based on 100 parts by weight resin (phr) of a low flexural modulus ionomer resin, and about 95 to about 40 phr of a conventional ionomer resin. A low flexural modulus ionomer is one that has a flexural modulus of less than 20,000 psi. Conventional ionomer resins are those that have a flexural modulus between 50,000 and 70,000 psi. Examples of suitable low flexural modulus ionomers and conventional ionomers are provided below.

Preferably, the amount of low flexural modulus ionomer resin used in the present invention is about 20 to about 50 phr and the amount of conventional ionomer resin used in the present invention is about 80 to about 50 phr.

Preferably, the low flexural modulus ionomer resin is a terpolymer comprising about 95 to about 50 parts by weight of an olefin such as ethylene, about 5 to about 13 parts by weight of an alpha, beta-unsaturated carboxylic acid such as acrylic or methacrylic acid and 0 to 50 parts by weight of an n- or iso-alkyl acrylate or methacrylate, in which about 10% to about 90% of the carboxylic acid groups are neutralized by a metal ion such as sodium, lithium, zinc, magnesium or the like.

Preferably, the conventional ionomer resin is a copolymer comprising about 95 to about 80 parts by weight of an olefin such as ethylene and about 5 to about 20 parts by weight of an alpha, beta-unsaturated carboxylic acid such as acrylic or methacrylic acid in which about 10% to 90% of the carboxylic acid groups are neutralized by a metal ion. Preferably, the conventional ionomer resin has about 10% to about 90% of the acid groups neutralized by lithium, sodium, zinc, magnesium or the like.

Preferably, the low flexural modulus ionomer resin used in the present invention has a flexural modulus between about 1,000 and about 20,000 psi (5 and 140 MPa) and, more preferably, between about 2,000 and about 10,000 psi (10 to 70 MPa).

[1] The flexural modulus is measured in accordance with A.S.T.M. Method D-790.

Preferably, the conventional ionomer resin has a higher flexural modulus which is between about 60,000 psi (415 MPa) and 70,000 psi (485 MPa). Good results have been obtained with the lithium ionomer resins having flexural moduli in the range of about 60,000 psi to about 70,000 psi (415 to 485 MPa), since these ionomers tend to exhibit a high initial velocity.

Preferably, the ionomer resins have the same monocarboxylic acid, e.g., either methacrylic or acrylic acid.

To aid in the processing of ionomer cover stock, it is conventional to use a plurality of ionomer resins to obtain the desired characteristics. Conventionally, ionomer resins with different melt flow indexes are employed to obtain the desired characteristics of the cover stock. In order to adjust the characteristics of the cover stock, other ionomer resins can be employed.

Low modulus, sodium ionomer resins sold by DuPont under the name SURLYN 8320, SURLYN 8269 and SURLYN 8265 work well in the present invention. Good results have been obtained with a conventional ionomer resin sold under the trade name SURLYN 8118, 7930, 7940 and 8660 by DuPont.

SURLYN 8320, SURLYN 8269 and SURLYN 8265 have flexural modulus of 2,800 psi (20 MPa), 2,800 psi (20 MPa) and 7,100 psi (50 MPa), respectively.[2] SURLYN 8118, 7930 and 7940 have flexural modulus of 61,000 psi (420 MPa), 67,000 psi (460 MPa) and 61,000 psi (420 MPa) respectively.

[2] Flexural modulus as published by DuPont.

SURLYN 8118, 7930 and 7940 have melt flow indexes of about 1.4, 1.8 and 2.6 g/10 min., respectively. SURLYN 8269 and SURLYN 8265 both have a melt flow index of about 0.9 g/10 min.[3] Preferably, the blend of ionomer resins used to make a cover of a golf ball in accordance with the present invention has a melt flow index between about 1 to about 4 g/10 min. and, more preferably, about 1 to about 3 g/10 min.

[3] Melt flow index is measured in accordance with A.S.T.M. Test D 1238, condition E, procedure A.

The combined amount of conventional ionomer resin and low modulus ionomer resin used to make a cover in accordance with the present invention as herein described generally makes up at least about 90% by weight of the total weight of the golf ball cover and, preferably, at least about 95% by weight. Additional materials which may be included in the golf ball cover are other SURLYN resins; whitening agents such as titanium dioxide; dyes; UV absorbers; optical brighteners; and other additives which are conventionally included in golf ball covers.

Golf ball covers made from ionomer resins in accordance with the present invention are made in a conventional manner by molding cover stock about a core. Molding is accomplished either by injection molding cover stock about a core or by compression molding preformed half-shells about a core.

The preferred method of forming ionomer resin covers over a core is compression molding. Half-shells are made by injection molding a cover stock into a conventional half-shell mold in a conventional manner. The preformed half-shells are then placed about a core and the assembly is introduced into a compression molding machine. The compression molding machine is a hydraulic press having an upper and lower mold plate. As taught by U.S. Pat. No. 4,508,309 issued Apr. 2, 1985, such mold plate has half molds, each of which is registered with another half mold in the opposite mold plate. It has been found that a golf ball is formed with a cover in accordance with the present invention when the half-shells are compression molded about a core at about 300° F. (149° C.) for about 3 minutes. The molded balls are then cooled while still in the mold and finally removed when the cover is hard enough to be handled without deforming.

After the balls have been molded, they undergo various conventional finishing operations such as buffing, painting and stamping.

Preferably, the cover stock used to make a golf ball cover in accordance with the present invention is a blend of the ionomer resins as specified hereinabove. Blending of the ionomer resins is accomplished in a conventional manner using conventional equipment. Good results have been obtained by mixing the ionomer resins in a solid, pelletized form and then placing the mix into a hopper which is used to feed the heated barrel of the half-shell or cover injection molding machine. Further mixing is accomplished by a screw in the heated barrel. Such machines are conventional.

Golf Ball Examples

These and other aspects of the present invention may be more fully understood with reference to the following non-limiting examples, which are merely illustrative of a preferred embodiment of the present invention golf ball, and is not to be construed as limiting the invention, the scope of which is defined by the appended claims.

The results obtained with a golf ball core and ball prepared according to the examples are provided to show the improved performance characteristics of golf ball core and cover made from the compositions of this invention. Example 20 represents a 1.68 inch diameter golf ball having a soft core made with zinc oxide present in an amount of less than 5 pph of polybutadiene and having a 1.58 inch diameter.

Example 21 represents a 1.68 inch diameter golf ball having a soft core made with calcium oxide present in an amount of less than 5 pph of polybutadiene and having a diameter of 1.58 inches. Both of the Examples 20 and 21 have a cover consisting essentially of about 30% of a low modulus ionomer (SURLYN 8320 is a sodium ionomer resin) and 70% of conventional ionomer (7940 is a lithium ionomer and 8660 is a sodium ionomer). The preferred low modulus ionomer is a sodium ionomer, but others such a low modulus zinc ionomers could be used. The preferred conventional ionomer is a lithium ionomer or blend of lithium ionomer with sodium or zinc ionomer. The test results show the significant low spin rate performance characteristics of Examples 20 and 21 over prior art balls. The test results do not show the improved feel that is achieved with the balls in Example 20 and 21. For example, because the compression of the cores is less than 60 and the balls is less than 70, the balls in Example 20 and 21 have a good feel when hit with a driver. Further, because the covers have a Shore D hardness of less than 62, they have a good feel when putting.

Table X sets forth the contents of the golf ball core that were made to illustrate the effect of using a softer, larger core with a soft cover according to the present invention. The core in Example 20 contains only 4.7 pph zinc oxide and the core in Example 21 contained 4.7 pph of calcium oxide. The composition used to prepare the golf ball cores of these examples are in parts per hundred (pph), based on 100 parts of polybutadiene, which was a mixture of Shell and Enichem rubbers. The fillers used in the compositions of these examples are regrind and polywate. DBDB-60 and Varox 231XL® are free radical initiators, and are a-a bis (t-butylperoxy) diisopropylbenzene and 1,1-di (t-butylperoxy) 3,3,5-trimethyl cyclohexane, respectively. The zinc diacrylate contained no more than about 4-8% zinc stearate.

The cores were prepared in the conventional manner set forth above and covered with the blend of SURLYN® as set forth in Table XI.

The cores and balls prepared according to the above-described method were tested for compression and initial velocity as set forth above. Both of these standard measurement techniques are well-known to those of ordinary skill in the art of making golf ball cores and balls.

TABLE X

CORE COMPOSITION (pph)

| Example No. | 20 | 21 |
|---|---|---|
| Polybutadiene | 100 | 100 |
| Regrind | 12.5 | 12.5 |
| DBDB-60 | 0.15 | 0.15 |
| Varox 231XL ® | 0.41 | 0.41 |
| Polywate | 21.4 | 19.2 |
| Zinc Diacrylate | 20.1 | 29 |
| Zinc Oxide | 4.7 | |
| Calcium Oxide | | 4.7 |

TABLE XI

COVER COMPOSITION

| Example No. | 20 | 21 |
|---|---|---|
| Low Modulus SURLYN | 30 | 30 |
| Conventional SURLYN | 70 | 70 |
| Hardness (Shore D) | 61 | 61 |

TABLE XII

| Example No. | 20 | 21 |
|---|---|---|
| Ball Initial Velocity (ft/s) | 250.1 | 249.7 |
| Core Compression | 52 | 55 |
| Ball Compression | 62 | 65 |

The following tables set forth the spin rate test data for the inventive golf balls made in Examples 20 and 21 above relative to known prior art golf balls. The Pinnacle Gold LS ball is comprised of a 1.55 inch diameter polybutadiene core covered with a Li/Na blend of conventional SURLYN and has a low spin rate. This ball is considered a good distance ball with a cover hardness of about 68 Shore D. The Titleist Tour Balata ball is comprised of a wound core covered by a balata rubber cover and has a high spin rate. This ball is considered to be a good performance ball, but is not a good distance ball. The cover is very soft and has a Shore D hardness of less than 60.

TABLE XIII

Spin Rate Test Results for a Driver

| Sample | Spin Rate (rpm) |
|---|---|
| Pinnacle Gold LS | 2900 |
| Titleist Tour Balata | 4380 |
| Example 20 | 2880 |
| Example 21 | 3220 |

TABLE XIV

Spin Rate Test Results for a 1/2 Wedge

| Sample | Spin Rate (rpm) |
|---|---|
| Pinnacle Gold LS | 6170 |
| Titleist Tour Balata | 7250 |
| Example 20 | 6550 |
| Example 21 | 6670 |

The test results in Table XIII shows that the ball having a soft cover comprised of a blend with low modulus sodium ionomer according to the present invention, Example 20, has surprisingly low spin characteristics because of the large soft core. In fact, the spin rate for the ball was lower than the Pinnacle Gold LS.

Both the Examples exhibited low driver spin rates like the Pinnacle Gold LS and ½ wedge spin rates that were better than the Pinnacle Gold LS. Thus, the overall distance of the balls according to Examples 20 and 21 are good. However, the feel of the balls according to Examples 20 and 21 are significantly better since the cover is significantly softer. Moreover, as stated above, the ball according to the present invention has a lower compression, about 80 points or lower, and thus, a good feel when hit with a driver.

In Examples 22-28, a control using barium sulfate as a filler was used with Shell 1220 as the rubber. Tungsten and BR60 were used in the cores of Examples 22-28.

TABLE XV

| | Control | Example 22 | Example 23 | Example 24 | Example 25 | Example 26 | Example 27 | Example 28 |
|---|---|---|---|---|---|---|---|---|
| Core Compression | 73 | 71 | 73 | 70 | 73 | 73 | 70 | 73 |
| Core Diameter (in.) | 1.590 | 1.590 | 1.590 | 1.590 | 1.590 | 1.590 | 1.590 | 1.590 |
| FUSABOND ® (weight %) | 20 | 25 | 20 | 20 | 20 | 25 | 25 | 25 |
| Cover Hardness (Shore D on ball) | 59 | 55 | 58 | 59 | 58 | 56 | 55 | 55 |
| Final Ball Compression | 81 | 75 | 81 | 79 | 83 | 78 | 78 | 79 |
| Final Ball Velocity (ft/s) | 252.2 | 253.6 | 252.0 | 254.6 | 255.0 | 251.9 | 254.7 | 255.0 |
| Final Ball COR | 0.801 | 0.812 | 0.790 | 0.820 | 0.823 | 0.800 | 0.811 | 0.797 |
| Driver Spin (RPM) | 3240 | 3290 | 3126 | 3103 | 3217 | 3224 | 3273 | 3198 |
| 8 Iron Spin (RPM) | 8170 | 8090 | 7655 | 7644 | 7747 | 7770 | 7778 | 7768 |
| 1/2 Wedge Spin (RPM) | 6580 | 6800 | 6171 | 6239 | 6281 | 6423 | 6376 | 6379 |
| Full Wedge Spin (RPM) | 10080 | 10330 | N/A | N/A | N/A | N/A | N/A | N/A |

Examples 29-30, shown in Table XVI, show the composition of two core embodiments.

TABLE XVI

| | Example 29 | Example 30 |
|---|---|---|
| Core compression | 70 | 73 |
| CB23 (phr) | 100.0 | 100.0 |
| ZDA (phr) | 25.5 | 26.5 |
| Tungsten (phr) | 14.1 | 13.77 |
| ZnO (phr) | 4.89 | 4.89 |
| Trigonox-265 (phr) | 0.53 | 0.53 |
| Color (phr) | 0.07 | 0.07 |

Trigonox-265 is a mixture of 1,1-di(t-butylperoxy)-3,3,5-trimethycyclohexane and di(2-t-butylperoxyisopropyl)benzene and is commercially available from Akzo Nobel Chemicals, Inc. of Chicago, Ill.

It will be understood that the claims are intended to cover all changes and modifications of the preferred embodiments of the invention, herein chosen for the purpose of illustration, which do not constitute a departure from the spirit and scope of the invention.

What is claimed is:

1. A golf ball having a diameter of less than about 1.70 inches, comprising:

a core formed from a rubber base material having a resilience index of about 40 or greater and an outer diameter of about 1.58 inches or greater, wherein the rubber base material comprises at least about 10 percent up to 80 percent trans-isomer; and a covet disposed about the core formed of a material having a hardness of less than about 55 Shore D, wherein the cover has a thickness of less than about 0.055 inches, wherein the golf ball has a coefficient of restitution of about 0.8 or greater.

2. The golf ball of claim 1 wherein the core has an outer diameter of about 1.59 inches or greater.

3. The golf ball of claim 1, wherein the rubber base material has a Mooney viscosity from about 45 to about 65.

4. The golf bail of claim 1, wherein The core has a coefficient of restitution from about 0.812 to about 0.818.

5. The golf ball of claim 1, wherein the core has a compression of less than about 75.

6. The golf ball of claim 1, wherein the core has a compression of about 80 or less.

7. The golf ball of claim 1, wherein the core comprises a filler material having a specific gravity of greater than about 10.

8. The golf ball of claim 1, wherein the cover comprises a polyurethane material.

9. The golf ball of claim 1, wherein the cover comprises a polyurea material.

10. The golf ball of claim 1, wherein the cover comprises a blend of at least one ionomer and at least one metallocene-catalyzed polymer.

11. The golf ball of claim 9, wherein the metallocene-catalyzed polymer is present in an amount of about 15 percent to about 60 percent by weight of the blend.

12. The golf ball of claim 1, wherein the rubber base material has a molecular weight of greater than about 300,000.

13. A two-piece golf ball having a diameter of less than about 1.70 inches, comprising:

a core formed from a rubber base material having a molecular weight of at least about 200,000 and an outer diameter of about 1.59 inches or greater, wherein the rubber base material comprises at least about 10 percent up to 80 percent trans-isomer; and a cover disposed about the core fanned of a material having a Shore D hardness of less than about 60, wherein the cover has a thickness of less than about 0.051 inches, wherein the golf ball has a coefficient of restitution of about 0.8 or greater.

14. The golf ball of claim 13, wherein the rubber base material has a Mooney viscosity of greater than about 40.

15. The golf ball of claim 13, wherein the core has a coefficient of restitution of about 0.81 or greater.

16. The golf ball of claim 13, wherein the core has a compression of about 80 or less.

17. The golf ball of claim 13, wherein the core has a compression of about 60 to about 75.

18. The golf ball of claim 13, wherein the core comprises a filler material having a specific gravity of greater than about 10.

19. The golf ball of claim 13, wherein the cover is formed of a material having a hardness of about 55 Shore D or less.

20. A solid golf ball having a diameter of less than about 1.70 inches, comprising:

a core having a compression of less than about 80 and an outer diameter of about 1.58 inches or greater, wherein the core is formed from a rubber base material having a Mooney viscosity of greater than about 40 and a trans-isomer content of at least about 10 percent up to 80 percent; and a cover disposed about the core formed of a material having a Shore D hardness of less than about 60, wherein the cover has a thickness of less than about 0.055 inches, wherein the golf ball has an initial velocity from about 250.1 feet per second and 253.44 feet per second and a compression from about 62 and 90.3.

21. The golf ball of claim 20, wherein rite core has a coefficient at restitution of about 0.80 or greater.

22. The golf ball of claim 20, wherein the core comprises a center and an outer layer.

23. The golf ball of claim 1, wherein the rubber base material further comprises cis-isomer and vinyl-isomer.

24. The golf ball of claim 13, wherein the rubber base material further comprises cis-isomer and vinyl-isomer.

25. The golf ball of claim 20, wherein the rubber base material further comprises cis-isomer and vinyl-isomer.

* * * * *